US005303924A

United States Patent [19]

Kluttz et al.

[11] Patent Number: 5,303,924

[45] Date of Patent: Apr. 19, 1994

[54] GOLF GAME SIMULATING APPARATUS AND METHOD

[75] Inventors: James W. Kluttz; Edgar P. Roberts, Jr., both of Winston-Salem, N.C.

[73] Assignee: Accu-Sport International, Inc., Winston-Salem, N.C.

[21] Appl. No.: 875,752

[22] Filed: Apr. 29, 1992

[51] Int. Cl.[5] ..... A63B 69/36

[52] U.S. Cl. ..... 273/185 R; 273/184 R; 273/181 C

[58] Field of Search ..... 273/181 R, 176 A, 181 G, 273/185 R, 181 C, 184 R, 184 A, 185 A, 185 B, 372

[56] References Cited

U.S. PATENT DOCUMENTS

| | | | |
|---|---|---|---|
| 3,598,976 | 8/1971 | Russell et al. | 273/183.1 |
| 3,633,008 | 1/1972 | Sanders | 273/183.1 |
| 3,671,724 | 6/1972 | Sanders | 273/183.1 |
| 3,712,624 | 1/1973 | Conklin . | |
| 4,192,510 | 3/1980 | Miller . | |
| 4,283,056 | 8/1981 | Miller . | |
| 4,343,469 | 8/1982 | Kunita et al. . | |
| 4,437,672 | 3/1984 | Armantrout et al. . | |
| 4,673,183 | 6/1987 | Trahan . | |
| 4,898,388 | 2/1990 | Beard, III et al. | 273/181 G |
| 5,029,866 | 7/1991 | Beard, III et al. . | |

*Primary Examiner*—Jessica J. Harrison

*Attorney, Agent, or Firm*—Bell, Seltzer, Park & Gibson

[57] ABSTRACT

A golf game apparatus that simulates a total golf shot distance based upon the actual flight time of a struck golf ball at a practice range and the linear flight distance of the ball to an initial impact position on an adjacent target area. The flight time and linear flight distance are used to simulate a roll distance which may be added to the linear distance to thereby produce the simulated golf shot total distance. A display positioned adjacent the tee area of the practice range may display a simulated golf hole layout with the simulated golf shot total distance indicated thereon for the player. The simulated golf ball roll distance may take into account a predetermined type of golf course surface upon which the struck golf ball initially impacts.

25 Claims, 4 Drawing Sheets

GOLF GAME SIMULATING APPARATUS AND METHOD

FIELD OF THE INVENTION

The present invention relates to the field of golf, and more particularly, to an apparatus and method for accurately simulating a golf shot including the roll distance thereof.

BACKGROUND OF THE INVENTION

The sport of golf has enjoyed tremendous popularity in recent times. Unfortunately, in many areas golf courses are overcrowded as new courses cannot be constructed fast enough to meet the surge in demand. As many recreational players will attest, golf can be a frustrating sport, especially when long waiting times and slow play hamper the player's ability to maintain even a consistent level of skill. Practice outdoor golf ranges are fairly common and serve to permit the player to practice a variety of shots with different clubs without the time commitment of playing 18 holes on a golf course. Indoor practice training devices are also available and these indoor facilities can remain open during times of the year when weather restricts play outdoors.

A number of golf practice aids have been developed including interactive video systems primarily for indoor use, such as the Birdie Rush manufactured by Joytec Ltd. of Burnaby, B.C., Canada. The available interactive video systems use several approaches for measuring the estimated speed and angle of the struck golf ball. Unfortunately, the estimated quantities do not predict with sufficient accuracy where a real golf ball would land and come to rest on a real golf course.

As is readily appreciated, wind speed, air temperature, air density, type of grass, type of ball, ball spin, and club affect the actual distance and path of a golf shot. Manufacturers of available interactive video games readily admit errors of 20%. However, skilled golfers, such as professionals and expert amateurs, can repeat a shot within 1%. Thus, an inaccurate system has little or no value to a skilled player as a golf practice aid. Interactive video systems do, however, offer entertainment for the player. For example, famous courses which are otherwise inaccessible may be readily programmed into a memory for display and simulated play. An example of a film-based simulation game is disclosed in U.S. Pat. No. 4,437,672 to Wilson. U.S. Pat. No. 3,712,624 to Conklin discloses a similar system including a screen for displaying a simulated position on a simulated golf hole layout wherein the trajectory of the struck ball is estimated based upon data from sensors positioned adjacent the tee area.

Outdoor golf practice ranges are available, and, such ranges include the effects of wind speed, air density, and other related factors on the flight of a struck golf ball which cannot be readily simulated. However, a golf practice range may be boring relative to the actual play, but is mandatory if improvement is desired.

A golf practice range cannot completely simulate actual shots on an 18 hole course. Attempts have been made to either increase the benefit gained by practicing at an outdoor range or to enhance its simulation of an actual golf course. For example, U.S. Pat. Nos. 4,192,510 and 4,283,056, both to Miller, disclose a computer-based video display of a simulated golf hole layout to be used in conjunction with an outdoor driving range. The display device is mounted adjacent the tee area of an outdoor practice range. After the player has executed a shot, the player then visually estimates the distance of the shot from a series of yardage markers on the target area. The player must then manipulate controls on the display device to "locate" the position of the shot on the simulated golf hole layout. Such a system, however, is more for entertainment than for serious practice as it is likely to be very inaccurate while at the same time being unnecessarily complicated for the player.

To increase the value of practice at a golf practice range, U.S. Pat. No. 4,673,183 to Trahan discloses a series of radar detecting units positioned at regular intervals and extending in a straight line outward from the tee area to thereby measure the distance of a shot and display the distance on a video display. The distance of the golf shot is estimated by determining the farthest away radar unit from the tee which detected the moving golf ball. However, the system provides only a gross estimate of the shot distance, and for a typical installation where the radar units have a detection range of 40 yards, the accuracy is only at best within 20 yards.

A substantial improvement in an automated system for measuring the distance of a golf shot at a practice range is disclosed in U.S. Pat. No. 5,029,866 to Beard, III et al. and assigned to the assignee of the present invention. An array of microphones or other acoustical detectors are positioned on the target area of the practice range. The signals generated by several adjacent sensors may be used to accurately determine the landing point of the struck golf ball by triangulation. The landing position of a golf ball is thus readily and accurately determined. Such information can be used to develop information of great benefit to the player. For example, the measured distances may be plotted in graphical form for a particular club, and statistical information, such as a mean distance for that club, may also be readily calculated. Although this system greatly improves the usefulness of golf practice, it measures only the impact location of a golf shot. But, the rolling of the golf ball after its initial impact, which may often be a significant component of the overall shot, is not determinable using the sensors alone.

SUMMARY OF THE INVENTION

The invention provides a golf practice system which can provide golf practice information and/or simulated golf play of substantially improved accuracy. The system of the invention can be used at a golf practice range to provide information and/or a visual display representative of a golf shot in which the total distance of the shot, including the roll distance of the golf ball after its initial impact, is provided. The system of the invention provides an accurate indication of roll distance without requiring wind speed measurements, temperature measurements, vertical flight measurements or the like.

The invention provides an apparatus for use at a golf practice range which simulates the total distance of a golf shot, including forward roll, based upon the linear distance from the tee area to the initial impact position of the golf ball on the target area and based on the flight time of the ball. More particularly, a simulated golf ball roll distance is determined and added to the linear distance from the tee area to the initial impact point on the target area. Because the simulated roll distance is calculated based on both flight distance and flight time, factors such as wind speed, vertical flight distance and the like are inherently compensated for without requiring measurement.

The system of the invention includes a sensor associ7 ated with the tee area, and preferably positioned adjacent the tee area for sensing a golf ball striking time which, in turn, is representative of the beginning of flight of the struck golf ball toward the target area. The sensor may be an optical detector such as a laser raster, a radar based detector, or an acoustic or vibration detector, such as a directional microphone for sensing the striking of the golf ball by the club of the player.

A sensor or an array of sensors is positioned on or adjacent the target area for sensing the initial impact time and initial impact position of the struck golf ball on the target area at the end of its flight. The sensor array is preferably an array of acoustic sensors as described in U.S. Pat. Nos. 4,898,388 and 5,029,886 and assigned to the assignee of the present invention, the disclosures of which are hereby incorporated herein by reference.

A processor, such as a microprocessor operating under stored program control, cooperates with the sensors to indicate on a display a simulated golf shot total distance including a simulated roll distance based upon the flight time of the struck golf ball and the initial impact position on the target area. Thus, a highly accurate simulated golf shot total distance is generated which includes the effects of wind speed, air density and other local factors at the practice range.

The processor includes means for determining the difference between the initial impact time of the struck golf ball on the target area and the striking time of the golf ball to thereby determine the flight time of the struck golf ball. The processor also includes means for determining the linear distance of the struck golf ball from the tee area to the initial impact position on the target area. The initial impact position of the struck golf ball is preferably determined by triangulation means cooperating with a sensor array on the target area.

The processor further includes means for determining the simulated golf ball roll distance based on the flight time and the linear distance of the struck golf ball. It has been found according to the invention that a relationship exists between the roll distance, the linear distance of the struck ball, and the flight time of the ball.

In addition, the processor may also include a memory cooperating therewith for storing at least one predetermined value relating to a golf ball roll distance on a predetermined type of golf course surface to be used in the formula for simulating the golf ball roll distance. Golf course surface variations can include grass type and/or length, slope and like variations. The memory also preferably includes data representing a simulated golf hole image and the processor includes means for displaying the simulated golf hole image on the display with the simulated golf shot total distance indicated thereon.

The processor preferably also includes means for storing a series of simulated golf shot total distances for a series of respective golf shots. Thus, statistical information of value to the player may be readily calculated, such as an average distance for a given golf club.

The method according to the present invention includes the steps of determining the flight time of a struck golf ball from the start of flight until the initial impact on the target area; determining the linear distance of the struck golf ball from the tee area to the initial impact position on the target area; and simulating a golf ball roll distance from the flight time and the linear flight distance. As described above with respect to the apparatus according to the invention, a simulated total golf shot distance may be indicated on a display along with a simulated golf hole layout.

A plurality of simulated total golf shot distances may be stored for a respective plurality of golf shots for later statistical analysis.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, applicants provide these embodiments so that this disclosure will be thorough and complete, and will fully convey the scope of the invention to those skilled in the art.

Figure 1:
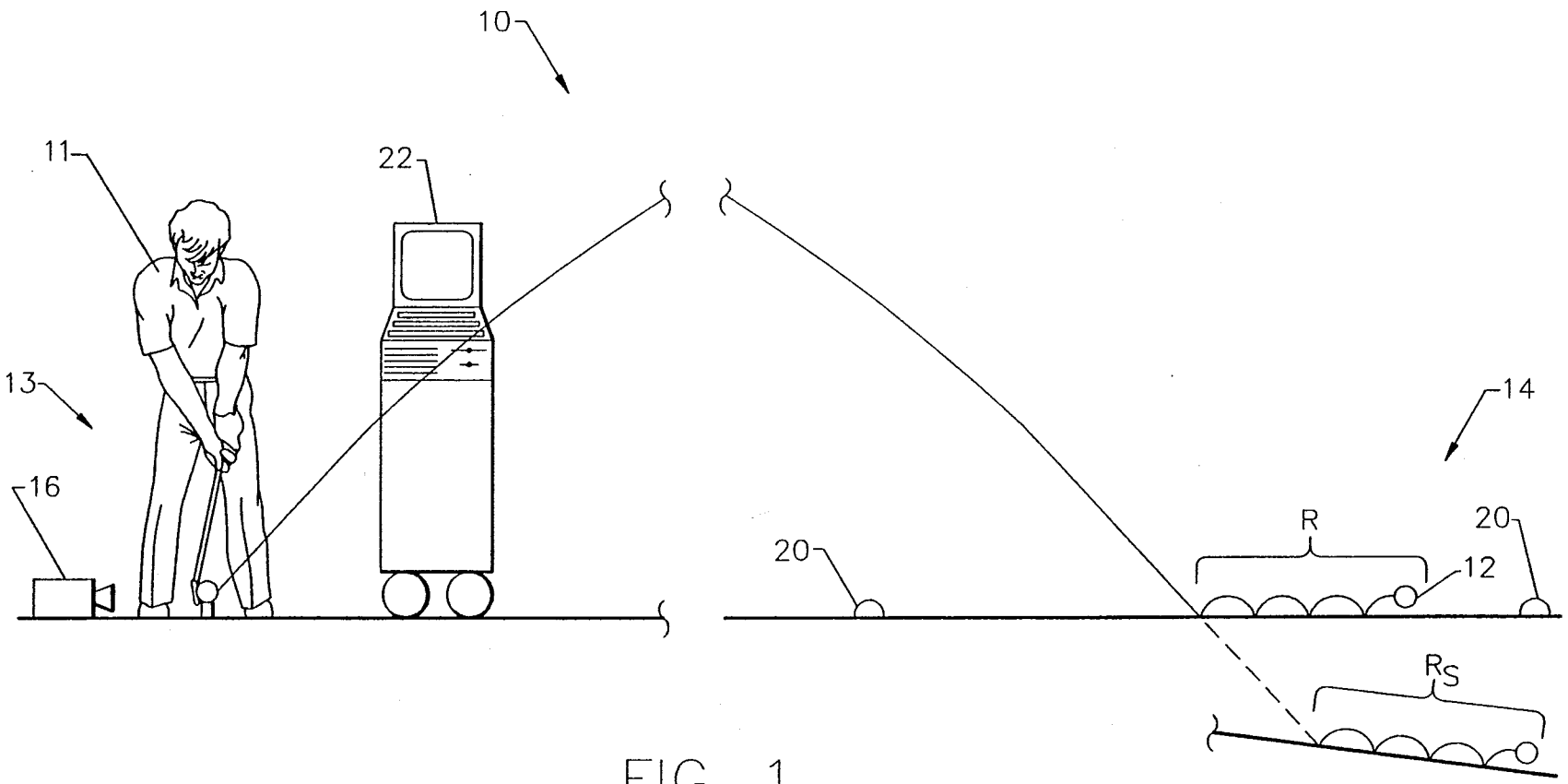
FIG. 1 is a schematic side elevational view of a practice golf range showing the path of a struck golf ball and a path, including ball roll, for a simulated impact point according to the invention.

The golf game apparatus 10 according to the present invention is shown in FIG. 1 installed at a golf practice range. At the practice range, player 11 strikes a golf ball 12 from a tee area 13. The struck golf ball 12 then travels to an initial impact location on an adjacent target area 14 where it then rolls a distance, R, to a stop at its final position.

Associated with the tee area 13 is a sensor 16 for determining when the golf ball 12 has been struck thereby beginning its flight. The sensor 16 may be an acoustical detector, such as a directional microphone directed toward the tee so that the striking of the ball by the club may be detected. The sensor 16 may also be an optical detector positioned adjacent the tee to determine when the golf ball is no longer positioned on the tee thereby indicating that the ball has been struck. It will be apparent that force sensors and/or numerous other sensors can be associated with the tee to determine striking of the ball and/or the time when the ball leaves the tee.

Figure 2:
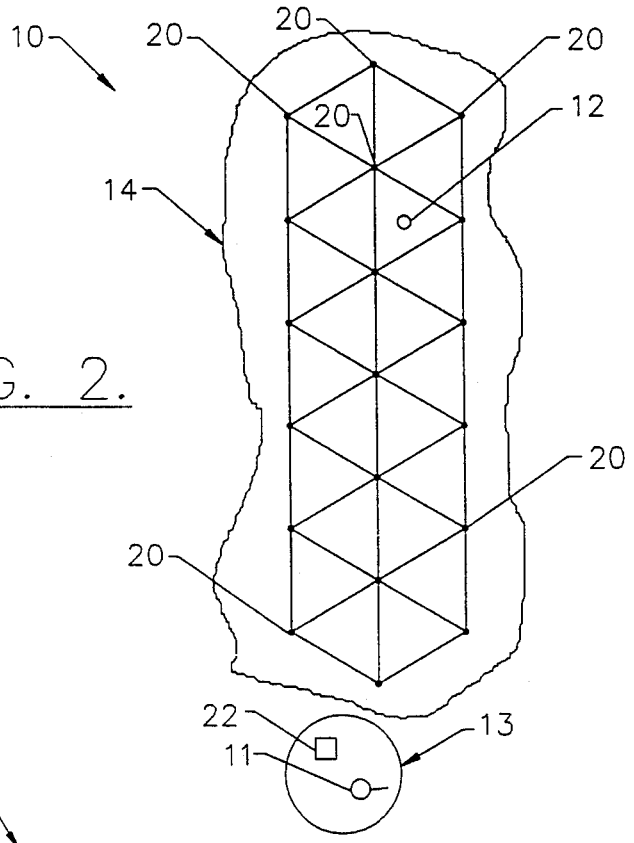
FIG. 2 is a plan view of the practice golf range as shown in FIG. 1 illustrating the positioning of an array of acoustical sensors on the target area and the regions covered thereby.

An array of sensors 20, such as acoustical sensors described in U.S. Pat. No. 5,029,886, are positioned on the target area 14 in a predetermined triangular pattern as shown best in the plan view of FIG. 2. The sensors 20 permit the initial impact position of the struck golf ball 12 to be determined with high accuracy as described in the patent. Although an array of sensors, as described above, is preferred in the invention, other means for sensing the impact and impact location of the ball can be employed if desired.

Figure 3:
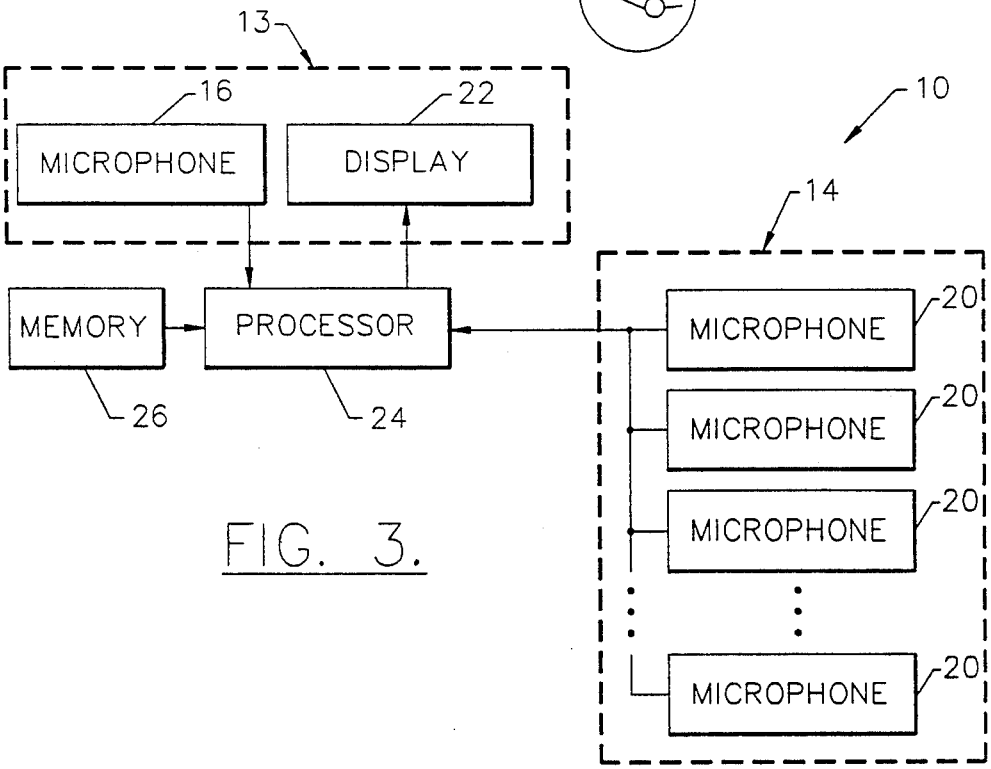
FIG. 3 is a schematic block diagram of the apparatus according to the present invention for generating an estimated distance of a golf shot.
Figure 4:
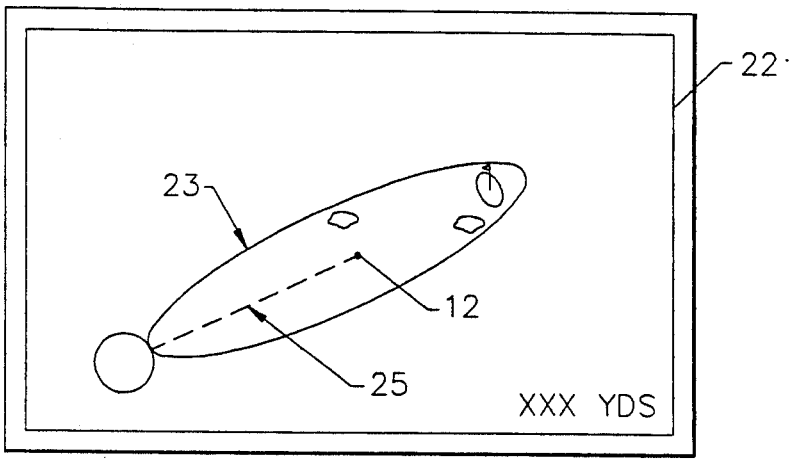
FIG. 4 is a view of a display according to the invention showing a simulated golf hole layout and the posi7 tion of the ball thereon corresponding to a simulated total distance according to the present invention.

Referring now to FIGS. 3 and 4, a display 22 is positioned adjacent the tee area 13 within view of the player 11. The display 22 is connected to a processor 24 for generating on the display an image of a golf hole layout 23, as well as indicating thereon a simulated golf shot distance and position 25. The processor 22 is preferably a microprocessor, as well known to those skilled in the art, operating under stored program control. The processor 24 may include a separate memory 26 as shown or the memory may be included initially within the microprocessor.

Figure 5:
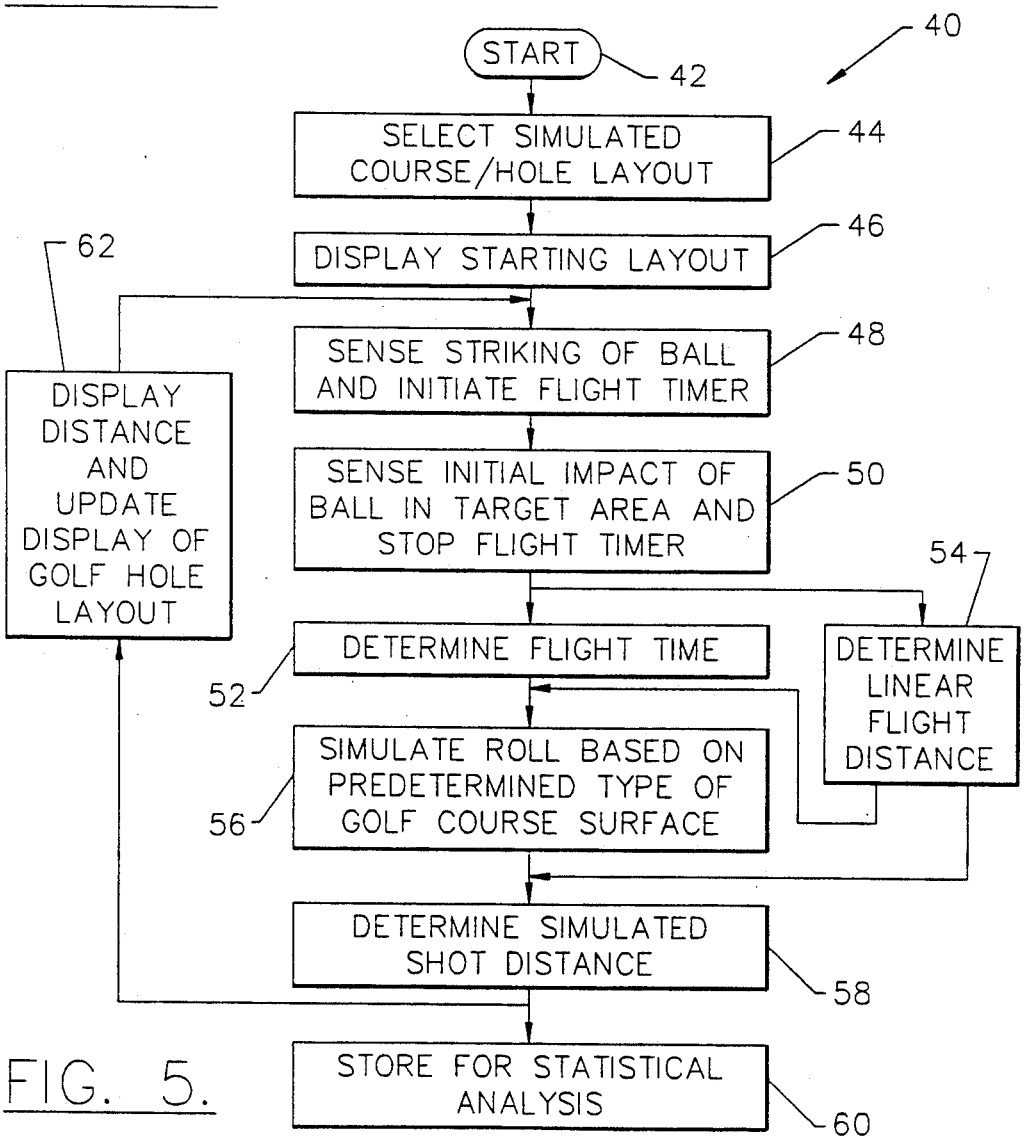
FIG. 5 is a flow draft illustrating the steps of generating simulated total distance of a golf shot according to the invention.

Referring to the Flowchart 40 of FIG. 5, the apparatus and method of the present invention may be understood. After starting the apparatus (Block 42), the player may select at Block 44 the simulated golf course and/or golf hole layout desired. For example, a famous course, such as Augusta National, the home of the Masters Tournament, may be stored in memory and displayed (Block 46) on the display 22 one hole at a time as would be readily understood by those skilled in the art.

The directional microphone 16 (FIG. 1) associated with the tee area 13 then senses the striking of the golf ball 12 which initiates a flight timer in the processor 24 at Block 48. The array of sensors 20 associated with the target area 14 in cooperation with the processor 24 then determine the initial impact position and stop the timer upon the initial impact of the struck golf ball 12 on the target area (Block 50). The total flight time is determined at Block 52, as well as the linear flight distance, or distance from the tee area to the initial impact position at Block 54.

The simulated roll distance of the struck golf ball is determined at Block 56 based upon a ratio of the linear flight distance to the square of the flight time. More particularly, it has been found according to the invention that there is a close correlation between the logarithm (base 10) of the roll distance and the ratio of the flight distance ($D_f$) to the square of the flight time ($T^2$). A simulated roll distance ($R_s$) may thus be accurately calculated from the following formula:

$$R_s = \text{Antilog}\ (mD_f/T^2 + b)$$

where m and b are appropriate predetermined values depending on the type of golf course surface upon which the ball lands. As shown in FIG. 1, the predetermined values may also take into account a slope of the initial impact point. Other factors can also be included such as grass length, course condition and like factors. The simulated roll distance is added to the linear flight distance at Block 62 to yield a total simulated shot distance. As would be readily understood by those skilled in the art, a difference in elevation between the actual impact point and a simulated impact point may also be factored into the total simulated distance. The total simulated shot distance includes the effects of external factors, such as the wind speed at the practice range, the air density, etc. because the actual flight of the ball is influenced by these.

As would be readily understood by those skilled in the art, predetermined values m and b for the calculation of the simulated shot total distance may be stored in memory 26 and may also be correlated to the initial impact position of the struck golf ball on the simulated golf hole layout 23. For example, if the struck golf ball were sliced so that it would have landed in the rough on the simulated golf hole layout, a correspondingly short roll distance would be added to the linear flight distance. In contrast, if the struck ball was hit straight down the center of golf hole fairway, a longer simulated roll distance could be applied.

A series of simulated golf shot total distances can be stored at Block 60 for subsequent statistical analysis. The simulated golf shot total distance can then be used to update the display (Block 62) so that an image of the simulated golf hole layout may be generated from the spot at which the simulated golf shot ended. A next shot may then be played, starting at Block 48, in a similar fashion.

The following Example is meant to be illustrative of the present invention and not limiting thereof.

EXAMPLE

Figure 6:
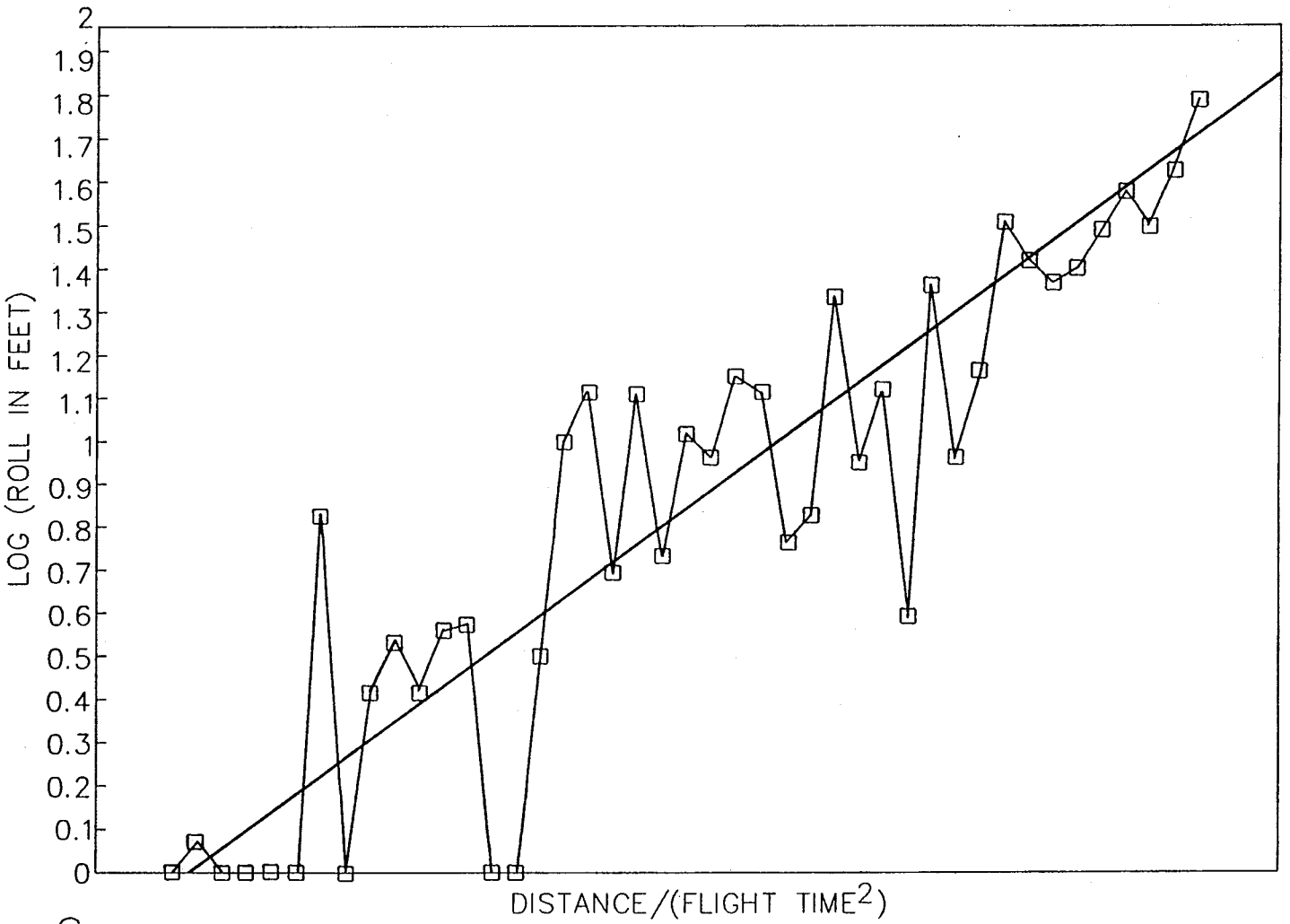
FIG. 6 is a graph illustrating measured roll data versus flight distance and flight time corresponding to the Example.

Measured roll distances, and respective flight times and linear flight distances, were obtained for 44 golf shots. FIG. 6 shows the calculated points representing the logarithm (base 10) of the measured roll distances plotted versus the ratio of the linear flight distance to the square of the flight time.

As shown in FIG. 6, a straight line approximation using $m=0.09949$ and $b=-0.75985$ yields a correlation coefficient of 0.874 It is to be noted that the x-intercept in FIG. 6 is a positive number, not zero. Accordingly, it is possible that simulated roll (on the Y-axis) could be a negative value. This condition accurately reflects possible conditions due to e.g. spin, wind, vertical flight and the like.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and variations are intended to be included within the spirit and scope of the invention as described in the foregoing specification and defined in the appended claims.

That which is claimed is:

1. An apparatus for use at a golf practice range having a tee area and an adjacent target area positioned to provide sufficient distance to allow landing of a struck golf ball thereon at the end of the complete flight path thereof, said apparatus comprising:

first sensor means adapted to be associated with the tee area for sensing a golf ball striking time representative of the beginning of flight of the struck golf ball toward the target area;

second sensor means adapted to be associated with the target area for sensing the initial landing time and initial landing position of the struck golf ball on the target area thereby ending its flight;

a display; and a processor operatively connected to said first sensor means, said second sensor means, and said display for indicating on said display a simulated golf shot total distance including a simulated golf ball roll distance, said roll distance being based upon a determined flight time of the struck golf ball and a determined initial landing position of same on the target area;

whereby a simulated golf shot total distance of improved accuracy is indicated.

2. The apparatus according to claim 1 wherein said processor comprises:

means for determining the difference between the initial landing time of the struck golf ball on the target area and the striking time of the golf ball to thereby determine the flight time of the struck golf ball;

means for determining the linear flight distance of the struck golf ball from the tee area to the initial landing position on the target area; and means for determining the simulated golf ball roll distance based on the flight time and the linear flight distance of the struck golf ball.

3. The apparatus according to claim 2 wherein said means for determining the simulated golf ball roll distance comprises means for determining a ratio between the linear flight distance and the square of the flight time.

4. The apparatus according to claim 2 further comprising a memory operatively connected to said processor for storing at least one predetermined value related to a golf ball roll distance on a predetermined type of surface of a golf course; and wherein said means for calculating the simulated golf ball roll distance of the simulated golf shot includes means for calculating said roll distance based upon said at least one predetermined value.

5. The apparatus according to claim 1 further comprising a memory operatively connected to said processor for storing data representing a simulated golf hole image; and wherein said processor further comprises means for displaying said simulated golf hole image on said display with the simulated golf shot total distance indicated thereon.

6. The apparatus according to claim 1 wherein said first sensor means comprises an optical sensor.

7. The apparatus according to claim 1 wherein said first sensor means comprises an acoustical sensor.

8. The apparatus according to claim 1 wherein said second sensor means comprises an array of spaced apart acoustical sensors adapted to be positioned on the target area.

9. The apparatus according to claim 8 wherein said processor further comprises triangulation means operatively connected to said array of acoustical sensors for determining the initial landing position of he struck golf ball on the target area.

10. The apparatus according to claim 1 further comprising a memory operatively connected to said processor for storing a series of simulated golf shot total distances for a series of respective golf shots.

11. An apparatus for use at a golf practice range having a tee area and an adjacent target area positioned to provide sufficient distance to allow landing of a struck golf ball thereon at the end of the complete flight path thereof, said apparatus comprising:

first sensor means adapted to be associated with the tee area for sensing a golf ball striking time representative of the beginning of flight of the struck golf ball toward the target area;

second sensor means adapted to be associated with the target area for sensing the initial landing time and initial landing position of the struck golf ball on the target area thereby ending its flight; and a processor operatively connected to said first sensor means and said second sensor means for generating a simulated golf shot roll distance, said roll distance being based upon a determined flight time of the struck golf ball and a determined initial landing position of same on the target area.

12. The apparatus according to claim 11 wherein said processor comprises:

means for determining the difference between the initial time of the struck golf ball on the target area and the striking time of the golf ball to thereby determine the flight time of the struck golf ball;

means for determining the linear flight distance of the struck golf ball from the tee area to the initial impact position on the target area; and means for determining the simulated golf ball roll distance based on the flight time and the linear flight distance of the struck golf ball.

13. The apparatus according to claim 12 wherein said means for determining the simulated golf ball roll distance comprises means for determining a ratio between the linear flight distance and the square of the flight time.

14. The apparatus according to claim 13 further comprising a memory operatively connected to said processor for storing at least one predetermined value related to a golf ball roll distance on a predetermined type of surface of a golf course; and wherein said means for calculating the simulated golf ball roll distance includes means for calculating said roll distance based upon said at least one predetermined value.

15. The apparatus according to claim 11 wherein said first sensor means comprises an optical sensor.

16. The apparatus according to claim 11 wherein said first sensor means comprises an acoustical sensor.

17. The apparatus according to claim 11 wherein said second sensor means comprises an array of spaced apart acoustical sensors adapted to be positioned on the target area.

18. The apparatus according to claim 17 wherein said processor further comprises triangulation means operatively connected to said array of acoustical sensors for determining the initial position of the struck golf ball on the target area.

19. A method of simulating a golf shot at a golf practice range having a tee area and an adjacent target area positioned to provide sufficient distance to allow landing of a struck golf ball thereon at the end of the complete flight path thereof, the method comprising the steps of:

determining the flight time of a struck golf ball from the start of flight until the initial landing on the target area;

determining the linear distance of the struck golf ball from the tee area to the initial landing position on the target area; and simulating a golf ball roll distance from the flight time and the linear flight distance.

20. The method according to claim 19 further comprising the steps of generating a simulated golf shot total distance and indicating same on a display.

21. The method according to claim 20 further comprising the step of displaying a simulated golf hole image on the display along with the simulated golf shot total distance.

22. The method according to claim 21 further comprising the step of storing in a memory a plurality of simulated total golf shot distances for a respective plurality of golf shots.

23. The method according to claim 20 wherein the step of generating the simulated golf ball roll distance comprises the step of generating said roll distance based upon a ratio of the linear distance to the square of the flight time.

24. The method according to claim 20 wherein the step of determining the initial landing position of the struck golf ball on the target area comprises the step of triangulating inputs from adjacent ones of an array of spaced apart acoustical sensors.

25. The method according to claim 20 wherein the step of simulating the golf ball roll distance comprises simulating same based upon a predetermined type of golf course surface.

* * * * *

UNITED STATES PATENT AND TRADEMARK OFFICE

CERTIFICATE OF CORRECTION

PATENT NO. : 5,303,924

DATED : April 19, 1994

INVENTOR(S) : Kluttz et al.

It is certified that error appears in the above-identified patent and that said Letters Patent is hereby corrected as shown below:

Column 3, line 3, "7" should be -- - --.

Column 4, line 22, "7" should be -- - --.

Column 8, line 42, between "initial" and "position" insert -- landing -- therefore.

Signed and Sealed this

Sixteenth Day of August, 1994

Bruce Lehman

*Attest:*

BRUCE LEHMAN

*Attesting Officer*

*Commissioner of Patents and Trademarks*